US007554488B2

(12) United States Patent
Mei et al.

(10) Patent No.: US 7,554,488 B2
(45) Date of Patent: Jun. 30, 2009

(54) PLANAR ANTENNA

(75) Inventors: Chia-Hao Mei, Shenzhen (CN); Jia-Lin Teng, Shenzhen (CN)

(73) Assignee: Hon Hai Precision Industry Co., Ltd., Tu-Chung, Taipei Hsien (TW)

( * ) Notice: Subject to any disclaimer, the term of this patent is extended or adjusted under 35 U.S.C. 154(b) by 184 days.

(21) Appl. No.: 11/309,877

(22) Filed: Oct. 17, 2006

(65) Prior Publication Data

US 2007/0279312 A1 Dec. 6, 2007

(30) Foreign Application Priority Data

Jun. 2, 2006 (TW) ..... 95119613 A

(51) Int. Cl.
*H01Q 1/38* (2006.01)

(52) U.S. Cl. ..... 343/700 MS

(58) Field of Classification Search ..... 343/700 MS, 343/702, 895, 748

See application file for complete search history.

(56) References Cited

U.S. PATENT DOCUMENTS

| | | | | |
|---|---|---|---|---|
| 6,531,985 | B1 * | 3/2003 | Jones et al. | 343/702 |
| 6,781,547 | B2 * | 8/2004 | Lee | 343/700 MS |
| 6,897,808 | B1 * | 5/2005 | Murch et al. | 343/700 MS |
| 7,333,068 | B2 * | 2/2008 | Biddulph | 343/794 |
| 2004/0201532 | A1 * | 10/2004 | Apostolos et al. | 343/742 |

* cited by examiner

*Primary Examiner*—Huedung Mancuso
(74) *Attorney, Agent, or Firm*—Wei Te Chung

(57) ABSTRACT

A planar antenna disposed on a substrate (100) includes a metallic ground plane (200), a radiating part (300), an open-short transforming part (400), a joint portion (700), and a feeding part (500). The metallic ground plane is laid on the substrate. The radiating part transmits and receives radio frequency (RF) signals, and includes a first bent portion (320) and an open end (310). The first bent portion is electrically connected to the open end. The open-short transforming part is electrically connected between the radiating part and the metallic ground plane, and includes a second bent portion (430). The joint portion connects the open-short transforming part and the radiating part, and defines a recessed portion (701). The feeding part is electrically connected to the joint portion, for feeding signals.

20 Claims, 22 Drawing Sheets

PLANAR ANTENNA

FIELD OF THE INVENTION

The invention relates to antennas, and particularly to a planar antenna.

DESCRIPTION OF RELATED ART

Wireless communication devices, such as mobile phones, wireless cards, and access points, wirelessly radiate signals via electromagnetic waves. Thus, remote wireless communication devices can receive the signals without the need for cables.

In a wireless communication device, the antenna is a key element for radiating and receiving radio frequency signals. Characteristics of the antenna, such as radiation efficiency, orientation, frequency band, and impedance matching, have a significant influence on performance of the wireless communication device. Nowadays, there are two kinds of antennas, built-in antennas and external antennas. Compared to the external antenna, the size of the built-in antenna is smaller, and the body of the built-in antenna is protected and not easily damaged. Thus, the built-in antenna is commonly employed in wireless communication devices. Common built-in antennas include low temperature co-fired ceramic (LTCC) antennas and printed antennas. The LTCC antenna has good performance at high frequencies and at high temperatures, but is expensive. A common type of printed antenna is the planar inverted-F antenna. Compared to LTCC antennas, planar inverted-F antennas are small, light, thin, and inexpensive. Accordingly, planar inverted-F antennas are mostly used in wireless communication devices.

In general, the planar inverted-F antenna is a printed circuit disposed on a substrate for radiating and receiving radio frequency signals. FIG. 1 is a schematic plan view of a conventional planar inverted-F antenna. The planar inverted-F antenna disposed on a substrate 10 includes a metallic ground plane 20, a radiating part 30, an open-short transforming part 40, and a feeding part 50. The metallic ground plane 20 is laid on the substrate 10, and includes an opening 60. The radiating part 30 includes an open end 31 and a first connecting end 33. The open end 31 terminates the radiating part 30.

The open-short transforming part 40 is connected between the radiating part 30 and the metallic ground plane 20, and includes a second connecting end 41 and a third connecting end 44. The third connecting end 44 is connected to the metallic ground plane 20. The second connecting end 41 is connected to the first connecting end 33 at a joint portion 70. The feeding part 50 is connected to the joint portion 70, for feeding signals. The feeding part 50 is connected to a matching circuit (not shown) through the opening 60.

In recent years, more attention has been paid on development of small-sized and low-profile wireless communication devices. Antennas, as key elements of wireless communication devices, have to be miniaturized accordingly. Although, the above-described planar inverted-F antenna is smaller than an external antenna, it is still too large for newer smaller wireless communication devices, and the profile of the above-described planar inverted-F antenna cannot be further reduced. Additionally, there is a demand for better performing planar inverted-F antennas. Therefore, what is needed is a planar inverted-F antenna with a compact profile and better performance.

SUMMARY OF THE INVENTION

An exemplary embodiment of the present invention provides a planar antenna. The planar antenna disposed on a substrate includes a metallic ground plane, a radiating part, an open-short transforming part, a joint portion, and a feeding part. The metallic ground plane is laid on the substrate. The radiating part transmits and receives radio frequency (RF) signals, and includes a first bent portion and an open end. The first bent portion is electrically connected to the open end. The open-short transforming part is electrically connected between the radiating part and the metallic ground plane, and includes a second bent portion. The joint portion connects the open-short transforming part and the radiating part, and defines a recessed portion. The feeding part is electrically connected to the joint portion, for feeding signals.

Other advantages and novel features will become more apparent from the following detailed description when taken in conjunction with the accompanying drawings, in which:

DETAILED DESCRIPTION OF THE INVENTION

Figure 1:
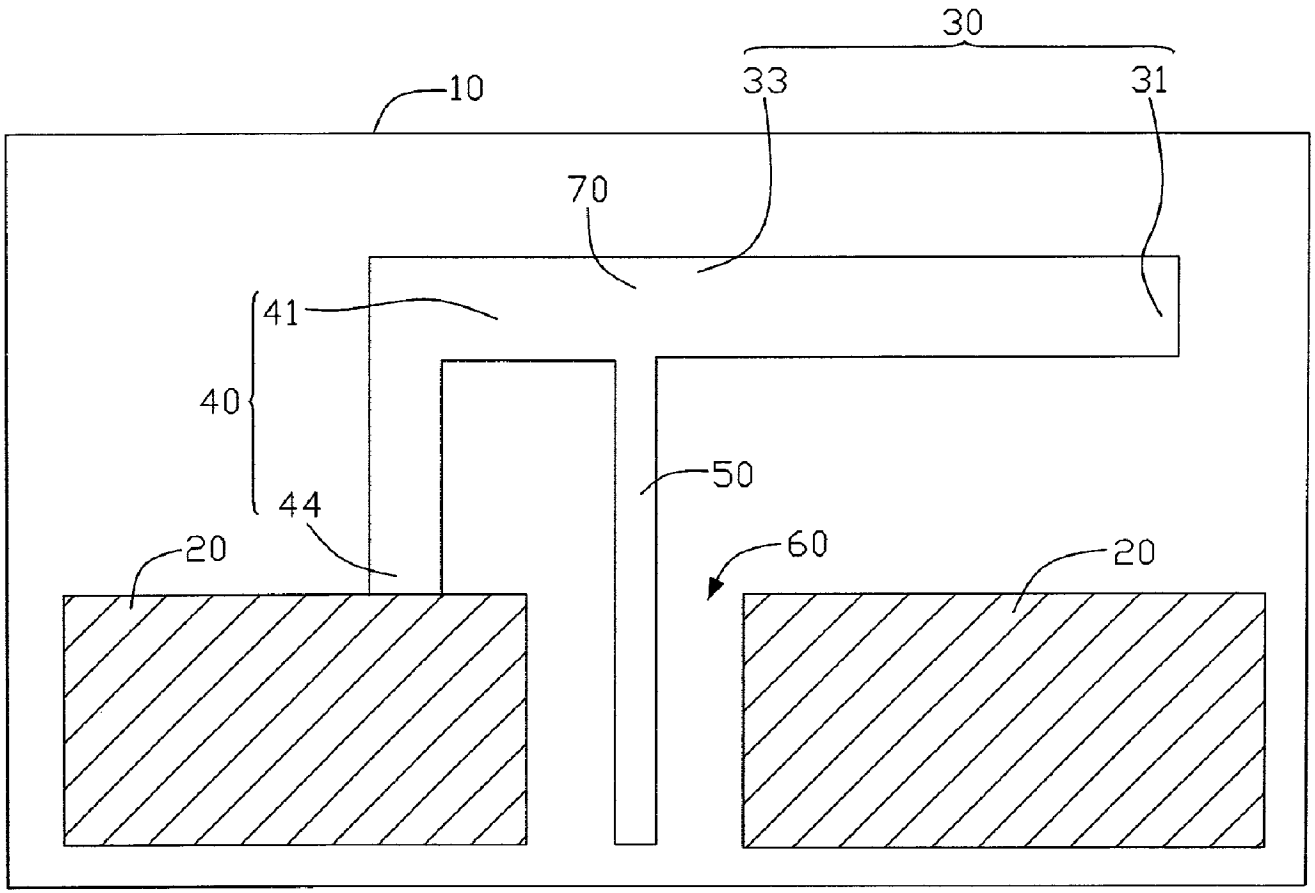
FIG. 1 (RELATED ART)
FIG. 1 is a schematic plan view of a conventional planar inverted-F antenna.
Figure 2:
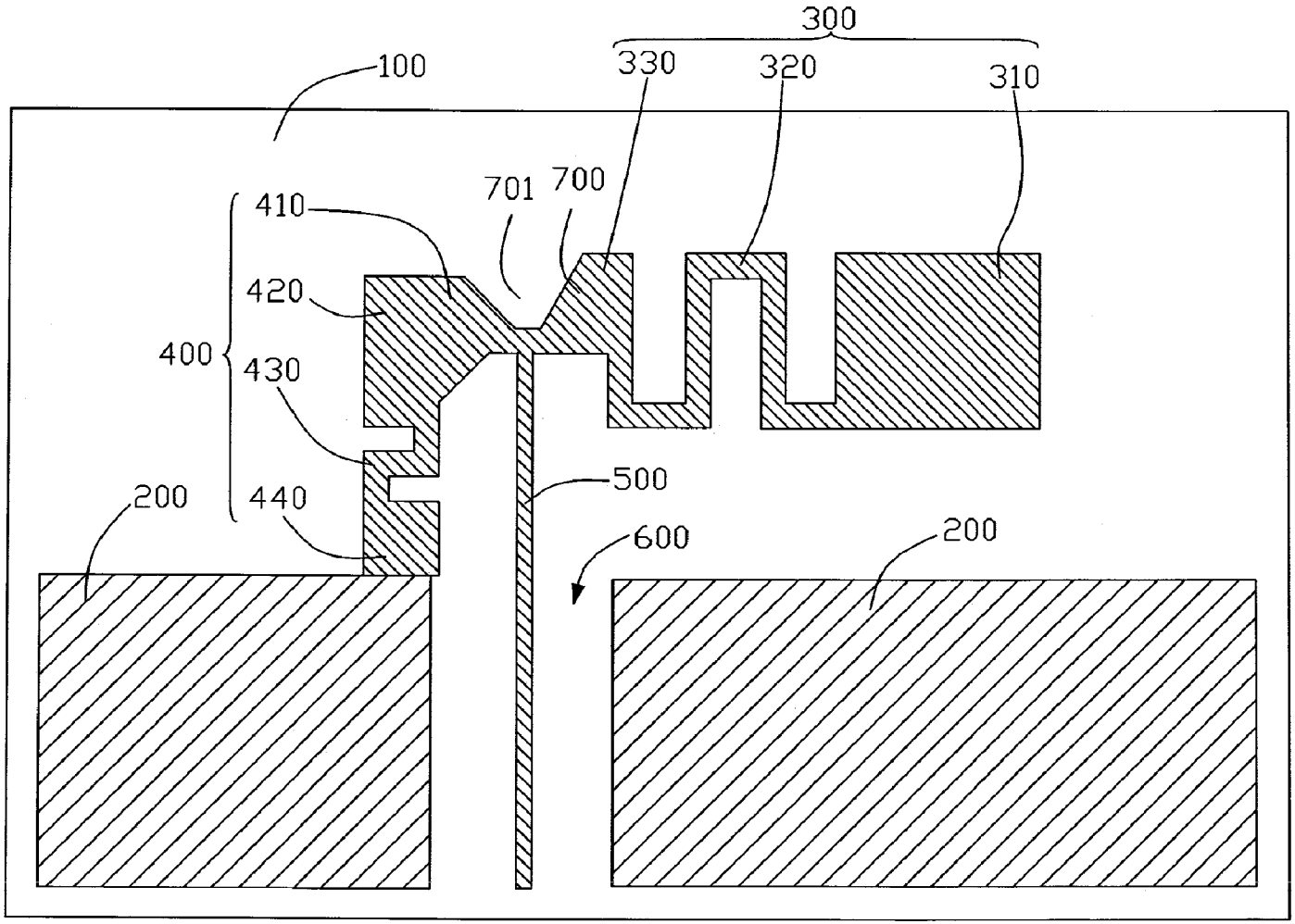
FIG. 2 is a schematic plan view of a planar antenna of an exemplary embodiment of the present invention.

FIG. 2 is a schematic plan view of a planar antenna of an exemplary embodiment of the present invention. In the exemplary embodiment, the planar antenna is disposed on a substrate 100, and includes a metallic ground plane 200, a radiating part 300, an open-short transforming part 400, a joint portion 700, and a feeding part 500. The metallic ground plane 200 is laid on the substrate 100, and includes an opening 600. The joint portion 700 electrically connects the open-short transforming part 400 and the radiating part 300.

The radiating part 300 transmits and receives radio frequency (RF) signals. In the exemplary embodiment, the radiating part 300 comprises metal. The radiating part 300 includes an open end 310, a first bent portion 320, and a first connecting end 330. The open end 310 terminates the radiating part 300.

The first bent portion 320 is electrically connected to the open end 310 and the first connecting end 330. In the exemplary embodiment, the first bent portion 320 is angular; that is, sharp-cornered.

In alternative embodiments, the first bent portion 320 may be curved, or a combination of angular portions and curved portions.

In other alternative embodiments, the radiating part 300 may include only one bent portion, or more than two bent portions.

In further alternative embodiments, the number of overlapping portions of the first bent portion 320 can be varied.

In the exemplary embodiment, the first bent portion 320 improves a return loss, and increases bandwidth of the planar antenna.

In the invention, the route of the electromagnetic wave is indirect, allowing precise control over the length of the route followed by the electromagnetic wave. The length of the route of the electromagnetic wave from the open end 310 to the first connecting end 330 must be kept to a predetermined length, such as substantially one half of the working wavelength of the planar antenna, and so the route is configured in a switchback pattern. Therefore, relatively speaking, the planar antenna of the present invention is configured in a compact manner allowing use in newer smaller wireless communication devices. That is, the planar antenna has a lower profile and a smaller size.

In addition, the planar antenna has a better radiation pattern due to the first bent portion 320.

The open-short transforming part 400 is electrically connected between the radiating part 300 and the metallic ground plane 200 via the joint portion 700. In the exemplary embodiment, a side of the open-short transforming part 400 adjacent to the feeding part 500 is offset with a side of the metallic ground plane 200 adjacent to the feeding part 500.

In other embodiments, the side of the open-short transforming part 400 adjacent to the feeding part 500 may be substantially aligned with the side of the metallic ground plane 200 adjacent to the feeding part 500.

The open-short transforming part 400 includes a second connecting end 410, a right-angled end 420, a second bent portion 430, and a third connecting end 440. The third connecting end 440 is connected to a via (not shown) of the metallic ground plane 200, for grounding. The second connecting end 410 is connected to the first connecting end 330 via the joint portion 700. In the exemplary embodiment, the joint portion 700 defines a recessed portion 701 extending therein. The recessed portion 701 is shaped as a polygon with its extending end closest to the feeding part 500, for enhancing an open effect of the planar antenna. Thus, the planar antenna has a better return loss due to the recessed portion 701 defined by the joint portion 700. In other embodiments, the joint portion 700 and its recessed portion 701 may be other shape.

The second bent portion 430 is disposed between the right-angled end 420 and the third connecting end 440. The extending direction of the second bent portion 430 is substantially vertical to the extending direction of the first bent portion 320. In the exemplary embodiment, the second bent portions 430 is angular; i.e., sharp-cornered.

In alternative embodiments, the second bent portion 430 may be curved, crooked, or a combination of angular portions and curved portions.

In other alternative embodiments, the open-short transforming part 400 may include only one bent portion, or more than two bent portions.

In further alternative embodiments, the number of overlapping portions of the second bent portion 430 can be varied.

In the invention, the route of the electromagnetic wave are indirect, allowing precise control over the length of the route followed by the electromagnetic wave. The length of the route of the electromagnetic wave from the second connecting end 410 to the third connecting end 440 must be kept to a predetermined length, such as substantially one fourth of a working wavelength of the planar antenna, and so the route is configured in a switchback pattern. Therefore, relatively speaking, the planar antenna of the present invention is configured in a compact manner allowing use in newer smaller wireless communication devices. That is, the planar antenna has a lower profile and a smaller size.

The feeding part 500 is electrically connected to the joint portion 700, for feeding signals. In the exemplary embodiment, the feeding part 500 is a 50Ω transmission line. The feeding part 500 is substantially parallel to the open-short transforming part 400 between the right-angled end 420 and the third connecting end 440, and is also electrically connected to a matching circuit (not shown) through the opening 600 of the metallic ground plane 200, for generating a matching impedance.

In the exemplary embodiment, the metallic ground plane 200, the radiating part 300, the open-short transforming part 400, and the feeding part 500 are printed on the substrate 100.

Figure 3:
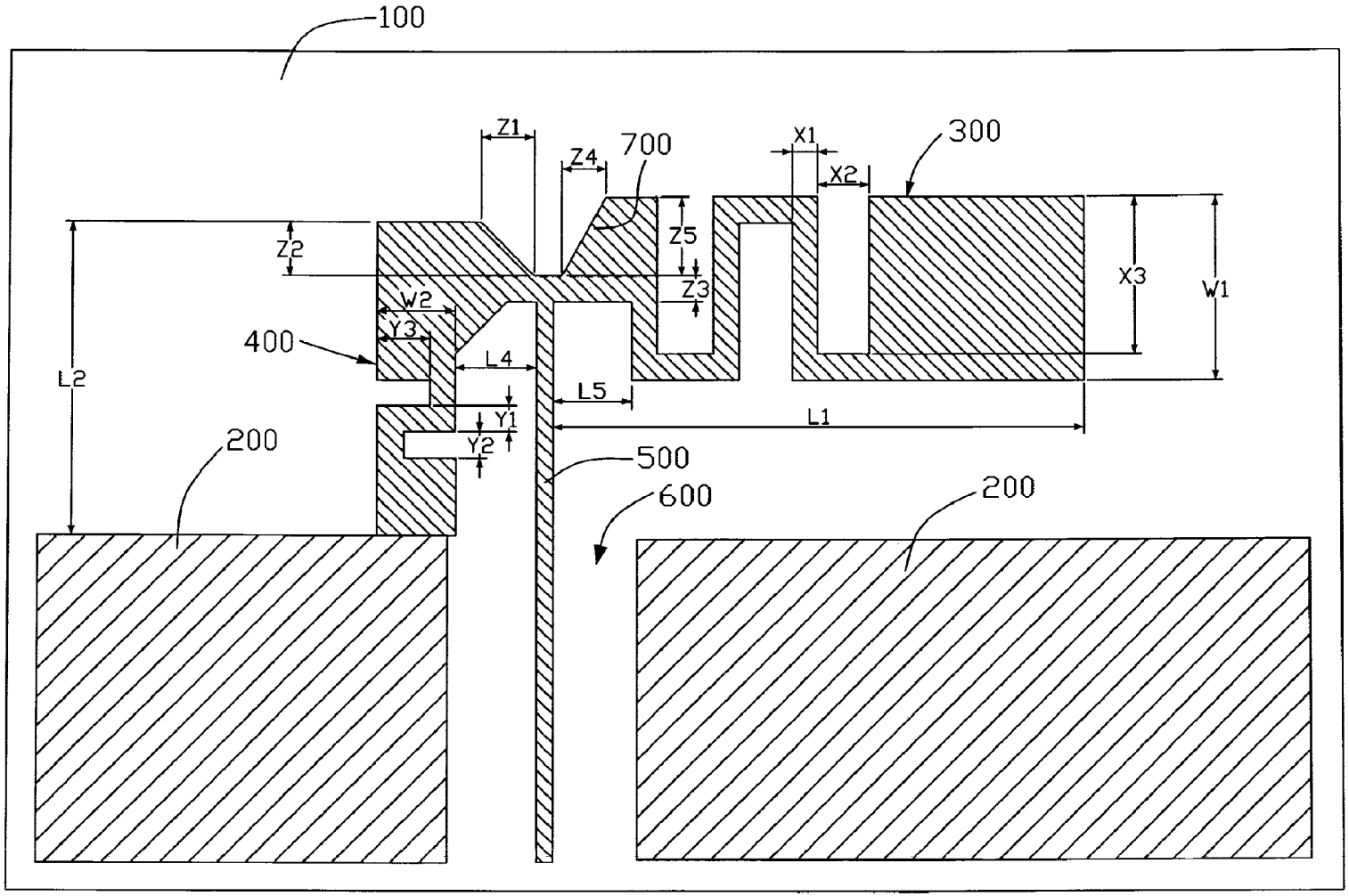
FIG. 3 is a schematic plan view illustrating dimensions of the planar inverted-F antenna of FIG. 2.

FIG. 3 is a schematic plan view illustrating dimensions of the planar antenna of FIG. 2. In the exemplary embodiment, a length L1 of the radiating part 300 is substantially 11.13 mm, and a width W1 of the radiating part 300 is substantially 3.5 mm. A length L2 of the open-short transforming part 400 is substantially 6 mm, and a width W2 of the open-short transforming part 400 is substantially 1.5 mm.

A parameter X1 of the first bent portion 320 is substantially 0.5 mm, a parameter X2 of the first bent portion 320 is substantially 1 mm, and a parameter X3 of the first bent portion 320 is substantially 0.5 mm. A parameter Y1 of the second bent portion 430 is substantially 0.5 mm, a parameter Y2 of the second bent portion 430 is substantially 0.5 mm, and a parameter Y3 of the second bent portion 430 is substantially 1 mm.

A parameter Z1 of the recessed portion 701 is substantially 1 mm, a parameter Z2 of the recessed portion 701 is substantially 1 mm, a parameter Z3 of the recessed portion 701 is substantially 0.5 mm, a parameter Z4 of the recessed portion 701 is substantially 0.87 mm, and a parameter Z5 of the recessed portion 701 is substantially 1.5 mm.

A distance L4 between the feeding part 500 and the second bent portion 430 is substantially 1.53 mm, and a distance L5 between the feeding part 500 and the first bent portion part 320 is substantially 1.63 mm.

With the above-described configuration, the planar antenna has a lower profile, a smaller size, a better return loss, and an omni-directional radiation pattern.

Figure 4:
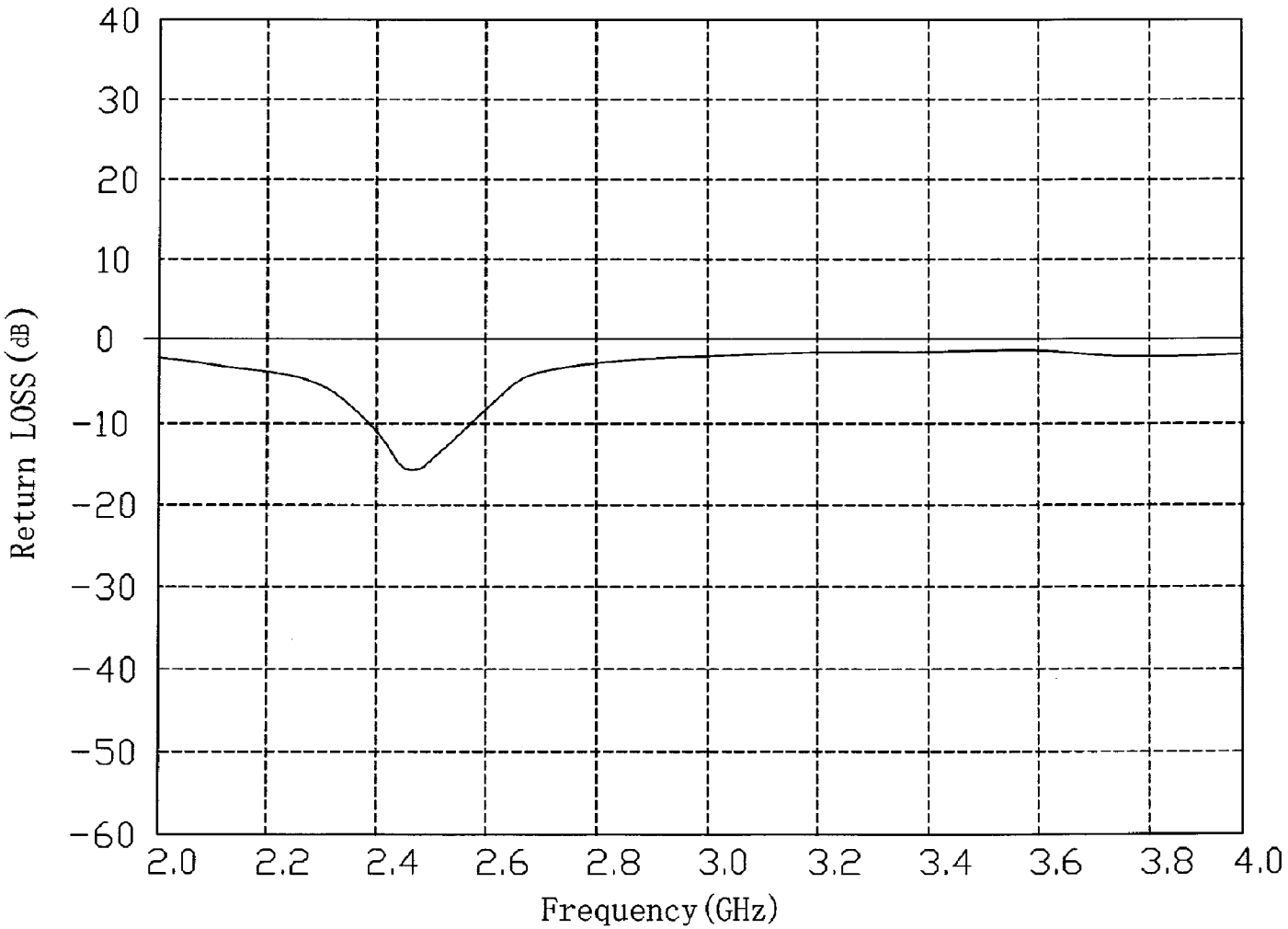
FIG. 4 is a graph of test results showing a return loss of the planar antenna of FIG. 2.
Figure 5:
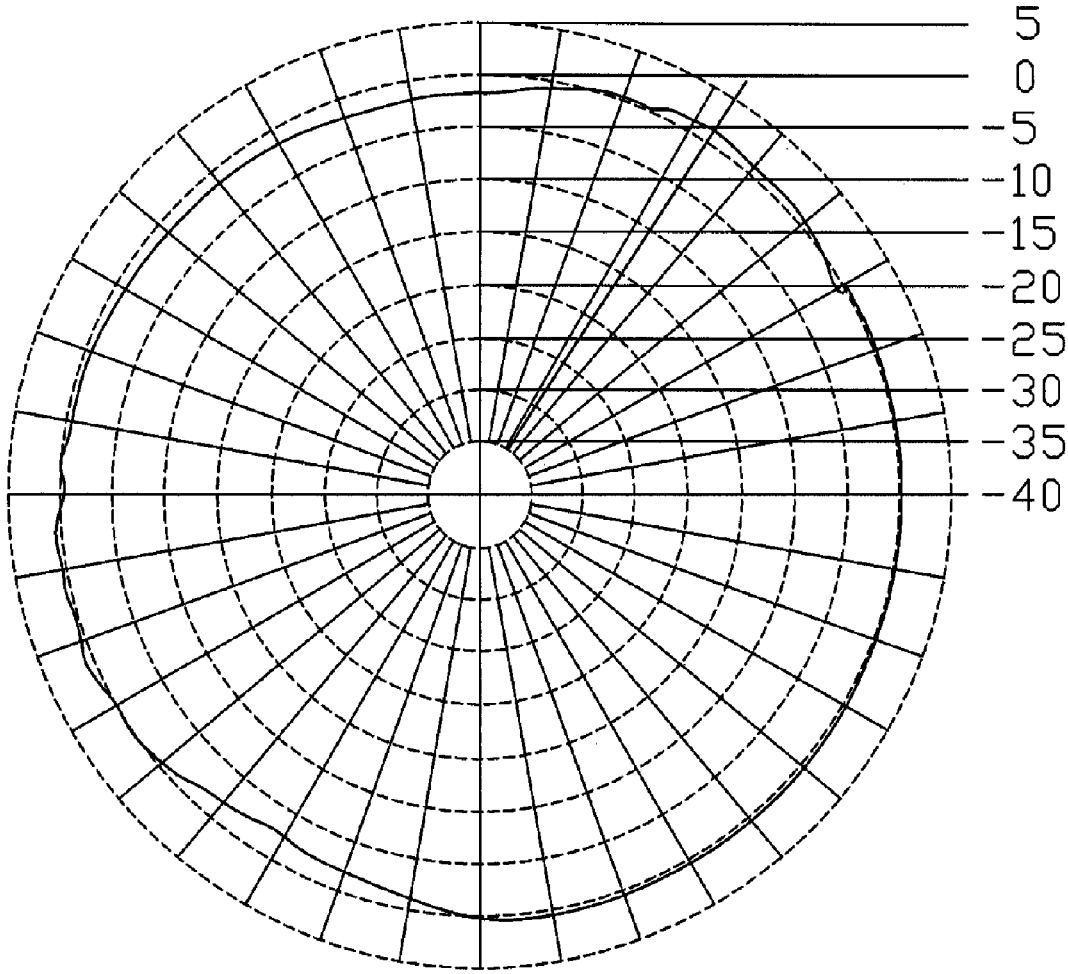
FIG. 5 is a graph of test results showing a YZ plane vertical polarization radiation pattern when the planar antenna of FIG. 2 is operated at 2.40 GHz.
Figure 6:
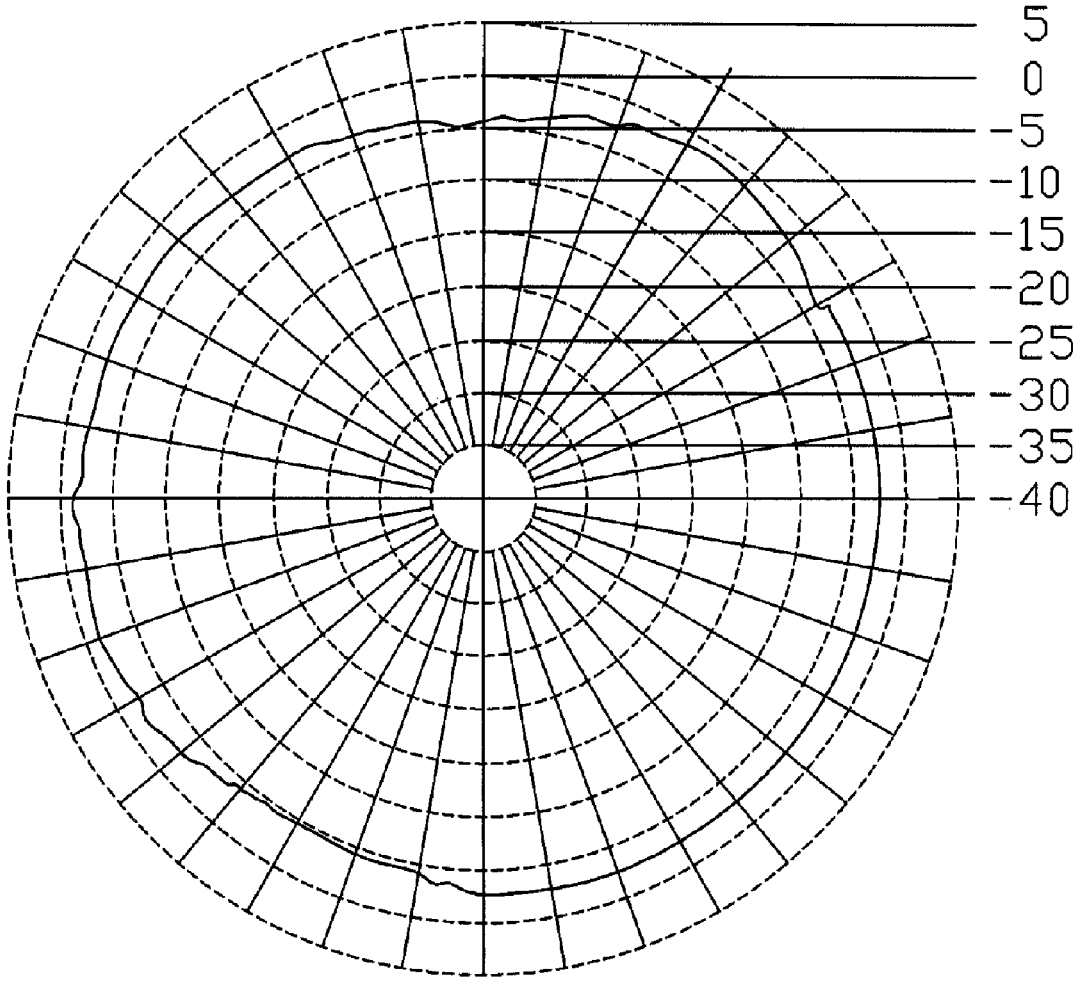
FIG. 6 is a graph of test results showing a YZ plane vertical polarization radiation pattern when the planar antenna of FIG. 2 is operated at 2.45 GHz.
Figure 7:
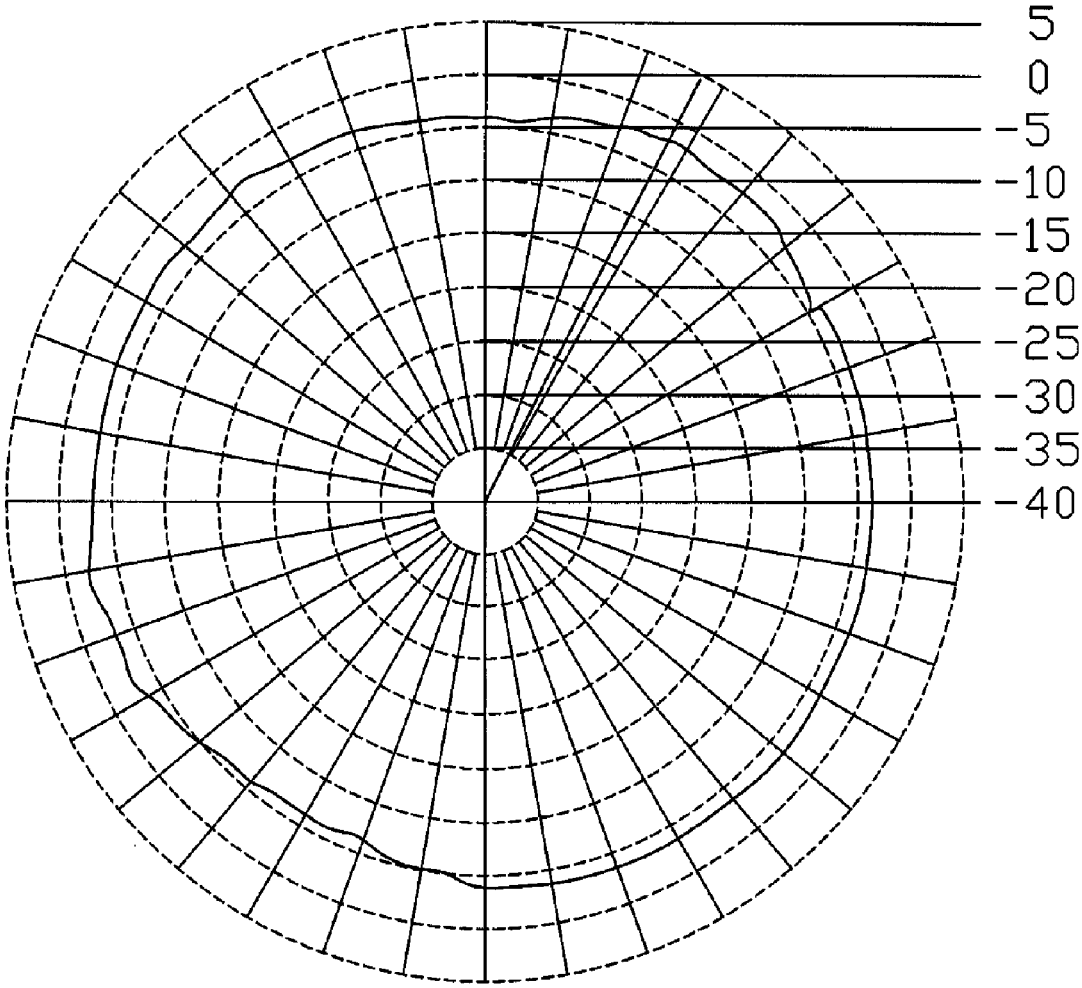
FIG. 7 is a graph of test results showing a YZ plane vertical polarization radiation pattern when the planar antenna of FIG. 2 is operated at 2.50 GHz.
Figure 8:
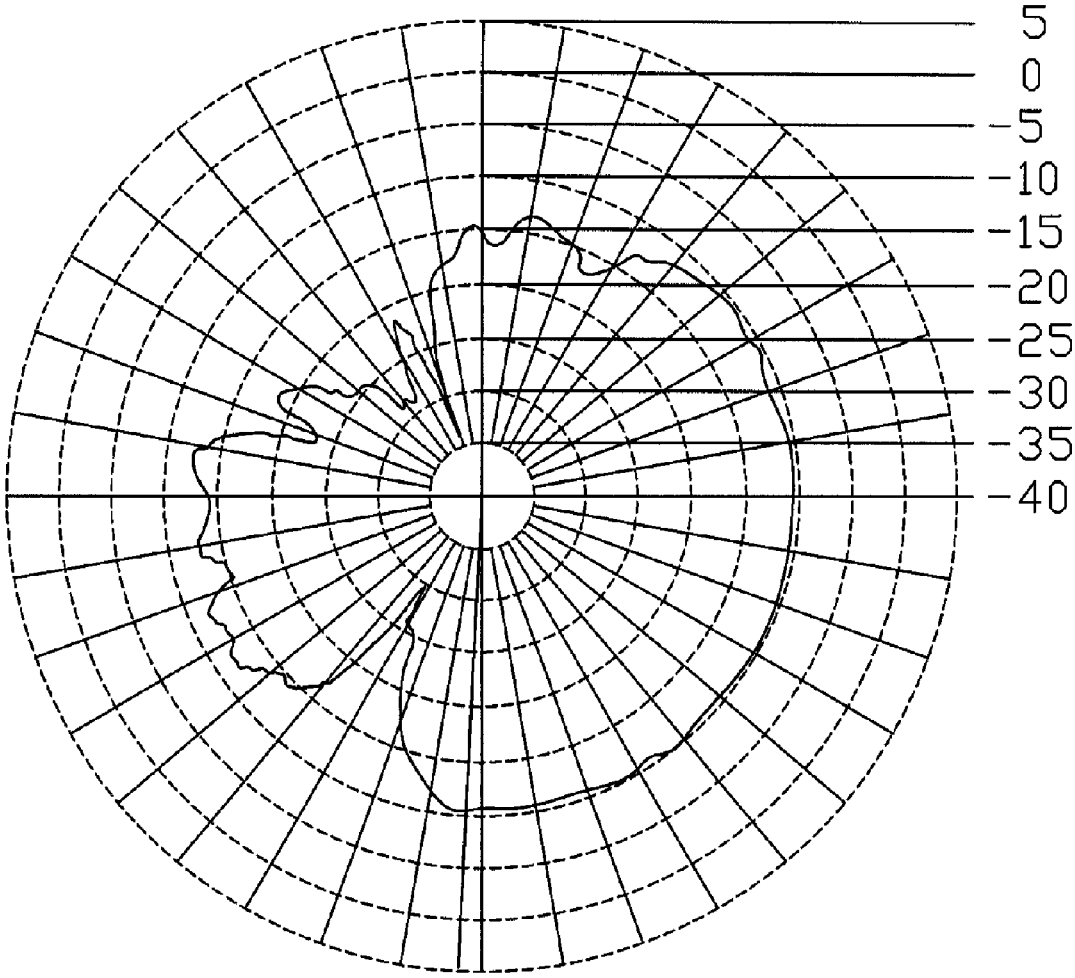
FIG. 8 is a graph of test results showing a YZ plane horizontal polarization radiation pattern when the planar antenna of FIG. 2 is operated at 2.40 GHz.
Figure 9:
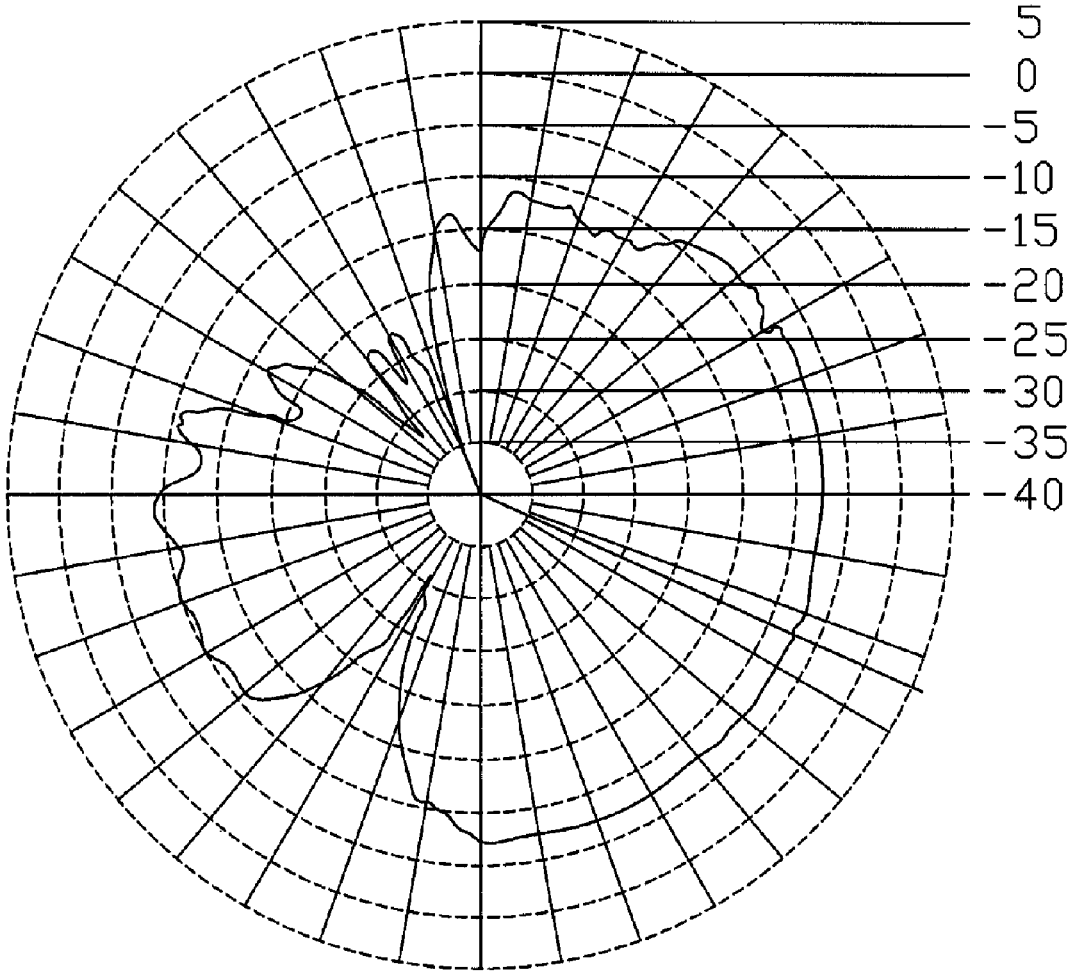
FIG. 9 is a graph of test results showing a YZ plane horizontal polarization radiation pattern when the planar antenna of FIG. 2 is operated at 2.45 GHz.
Figure 10:
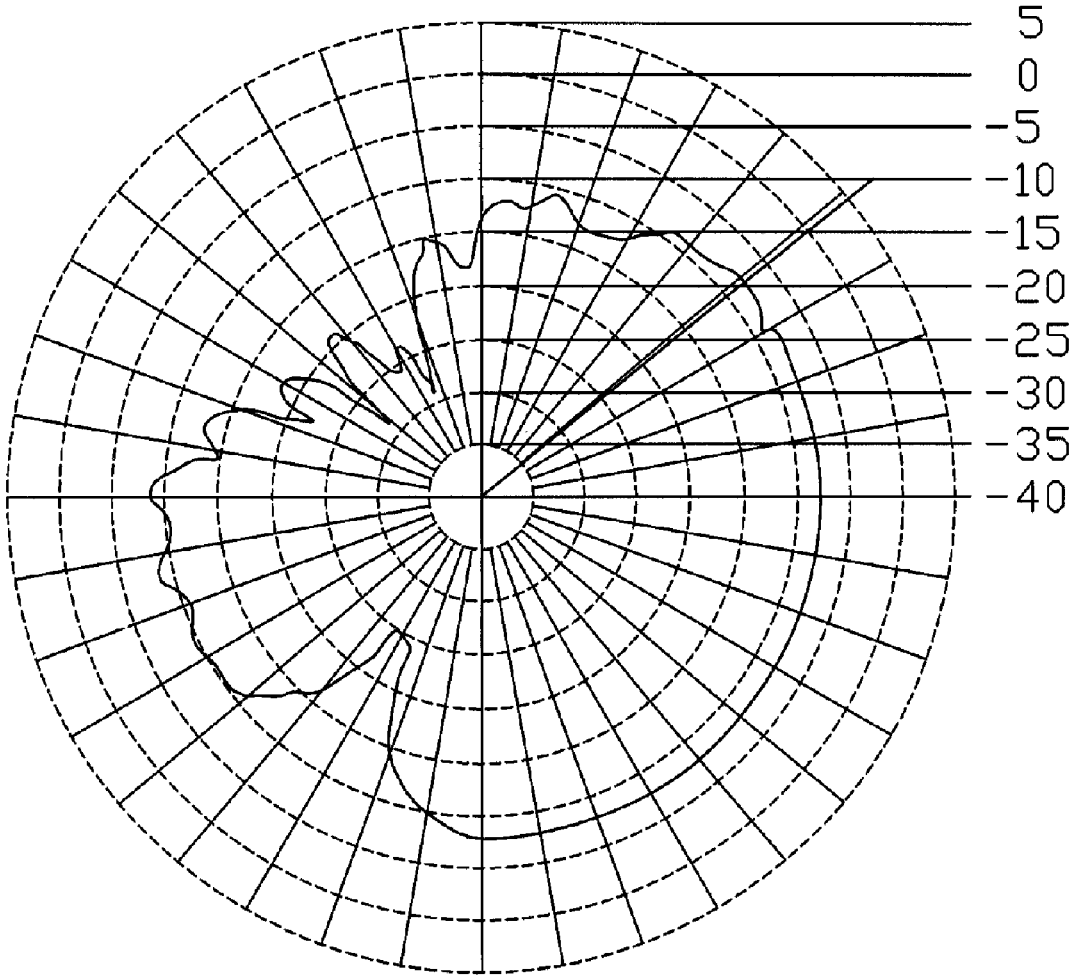
FIG. 10 is a graph of test results showing a YZ plane horizontal polarization radiation pattern when the planar antenna of FIG. 2 is operated at 2.50 GHz.
Figure 11:
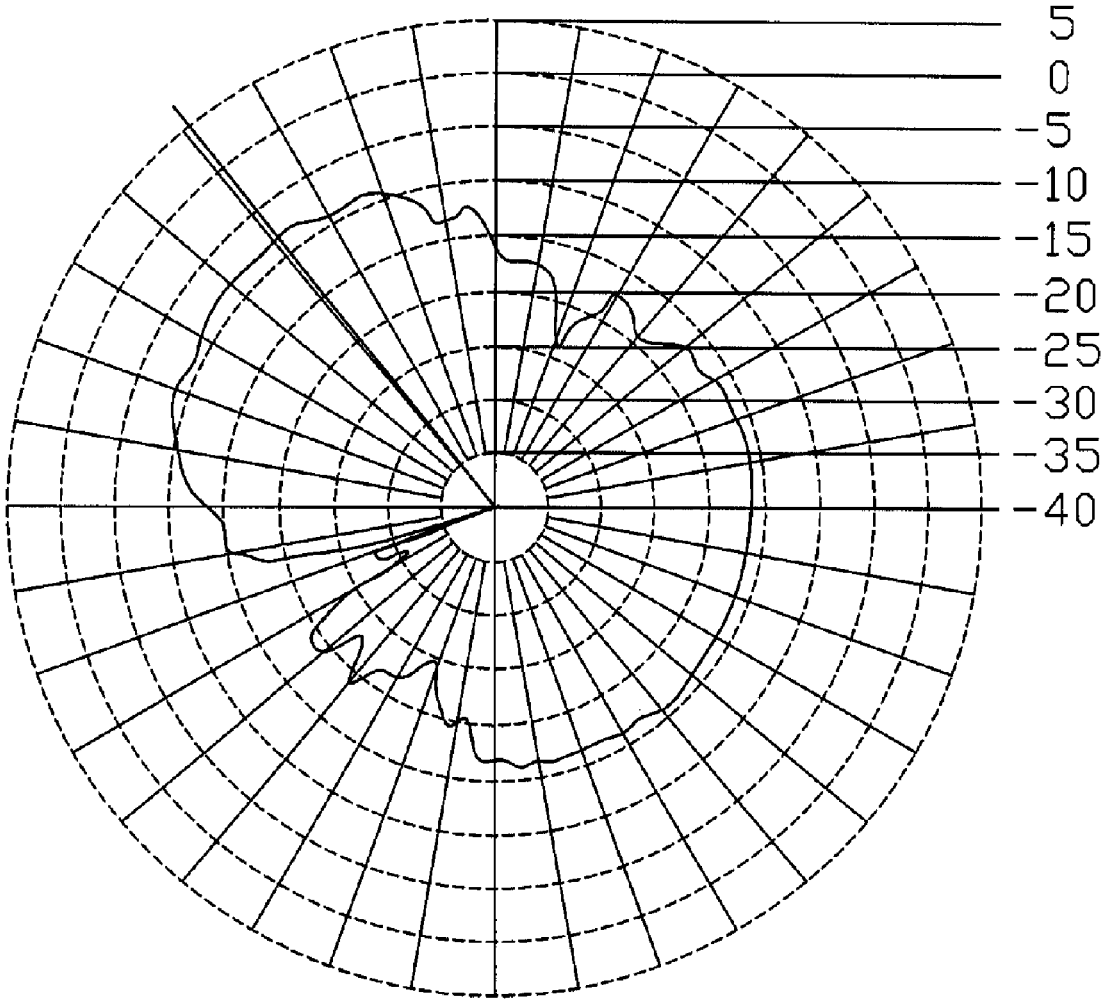
FIG. 11 is a graph of test results showing a XY plane vertical polarization radiation pattern when the planar antenna of FIG. 2 is operated at 2.40 GHz.
Figure 12:
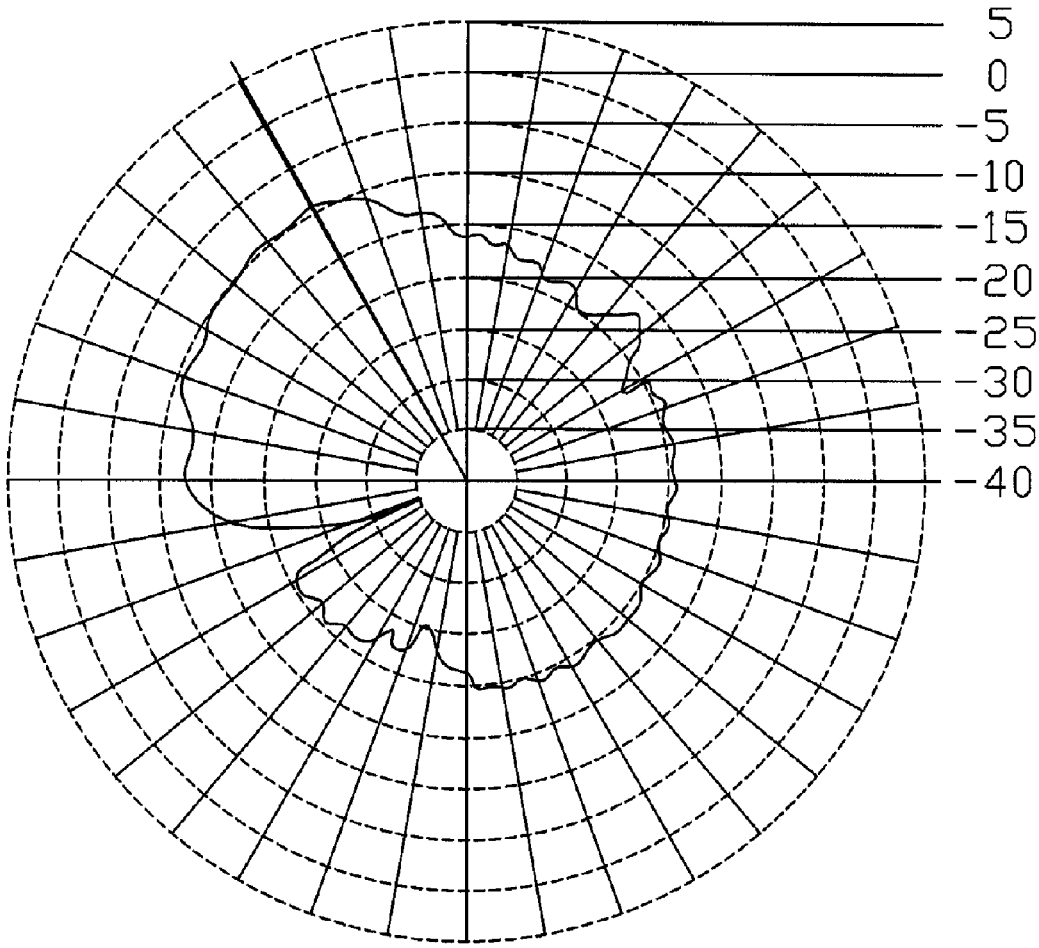
FIG. 12 is a graph of test results showing a XY plane vertical polarization radiation pattern when the planar antenna of FIG. 2 is operated at 2.45 GHz.
Figure 13:
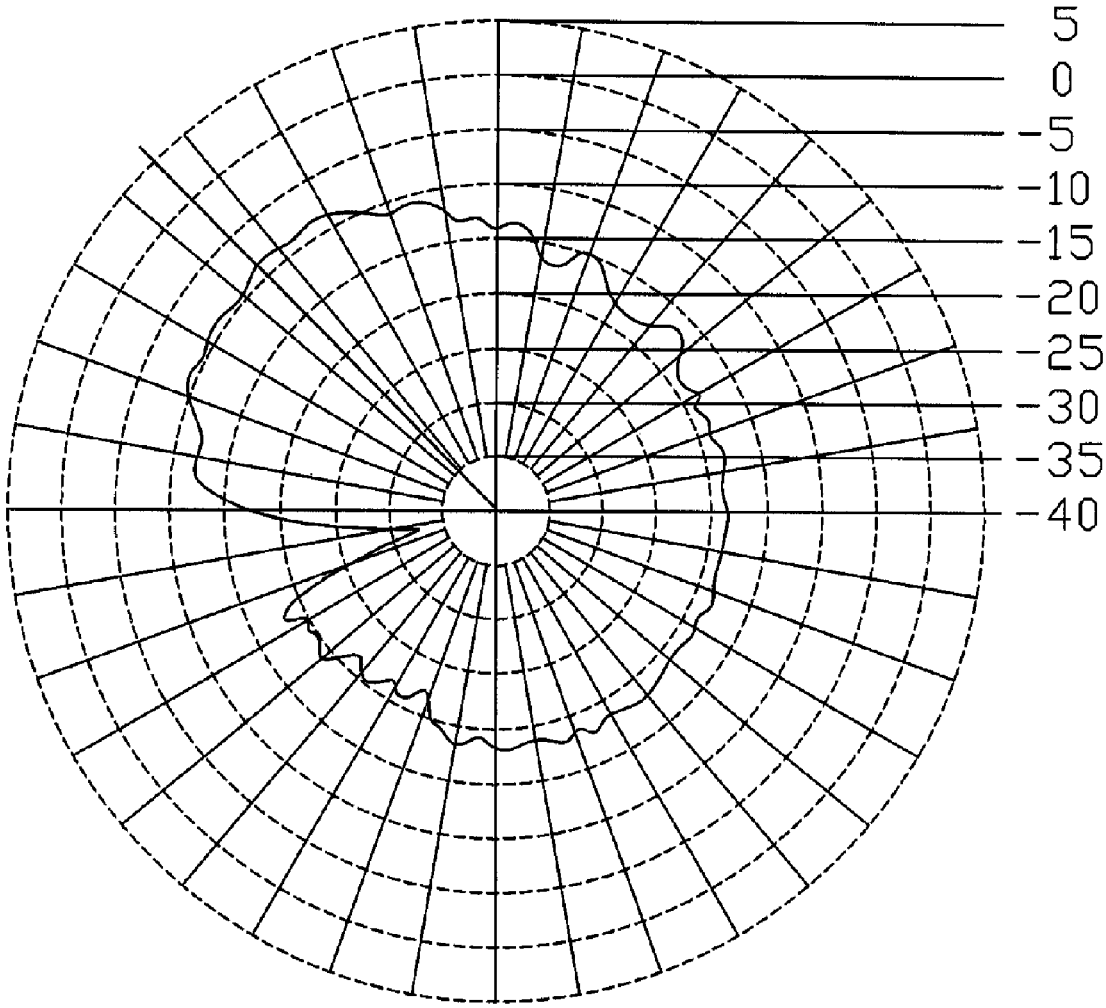
FIG. 13 is a graph of test results showing a XY plane vertical polarization radiation pattern when the planar antenna of FIG. 2 is operated at 2.50 GHz.
Figure 14:
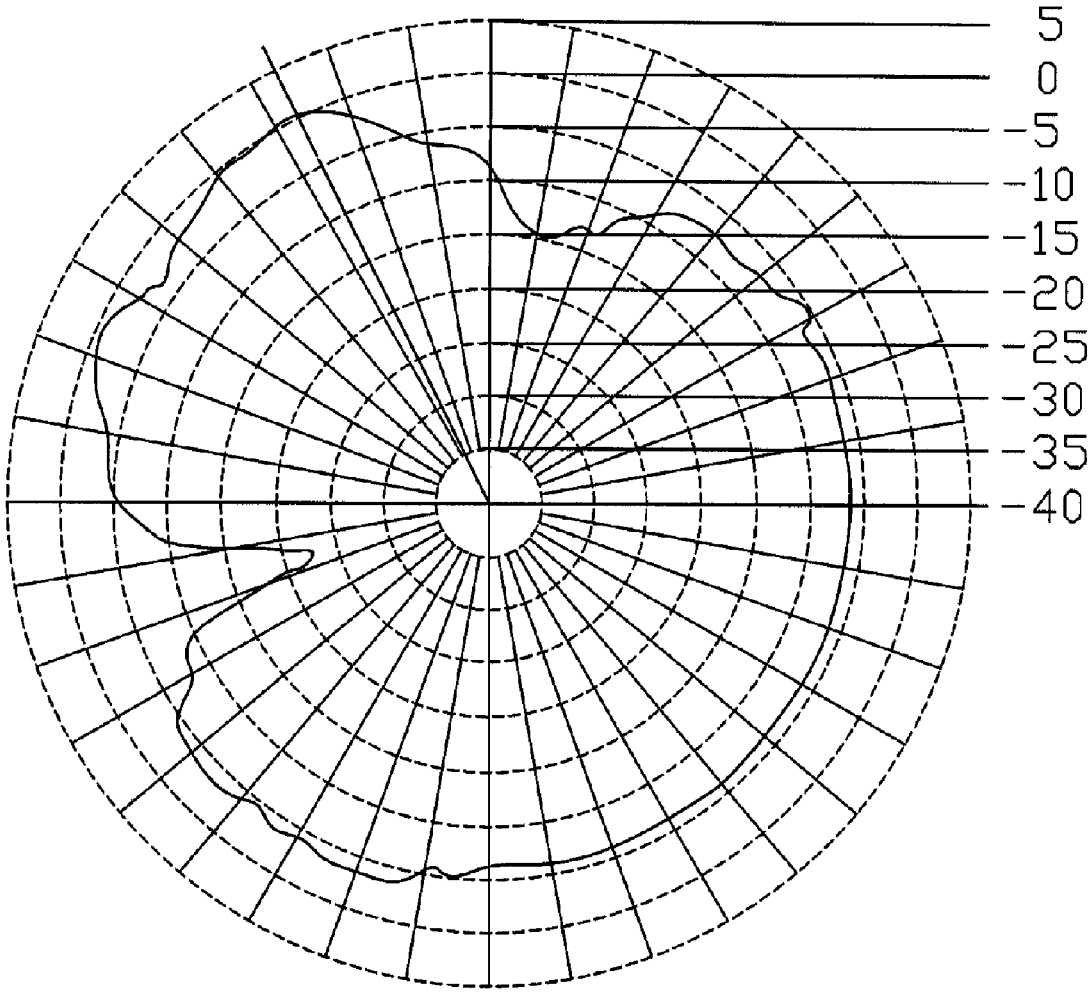
FIG. 14 is a graph of test results showing a XY plane horizontal polarization radiation pattern when the planar antenna of FIG. 2 is operated at 2.40 GHz.
Figure 15:
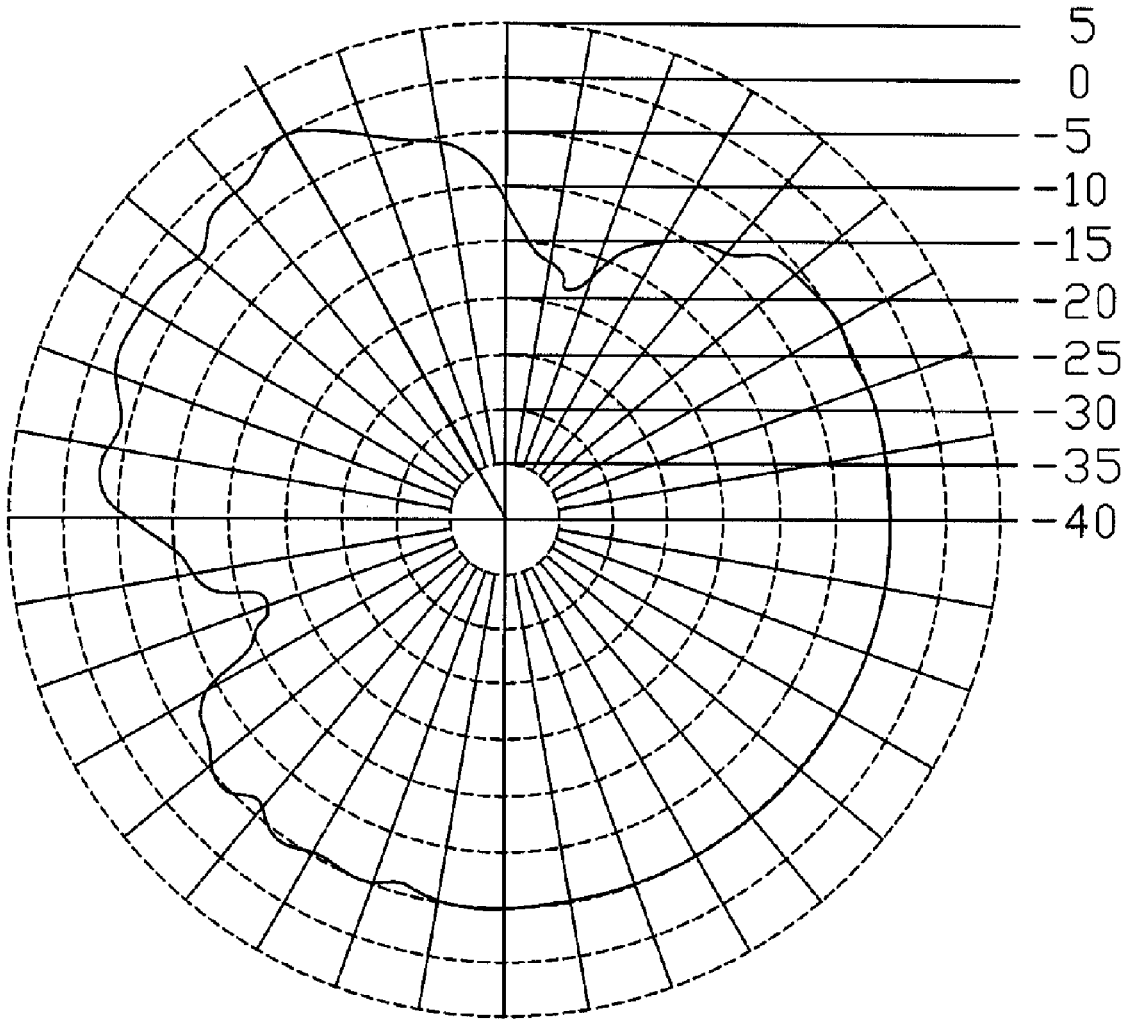
FIG. 15 is a graph of test results showing a XY plane horizontal polarization radiation pattern when the planar antenna of FIG. 2 is operated at 2.45 GHz.
Figure 16:
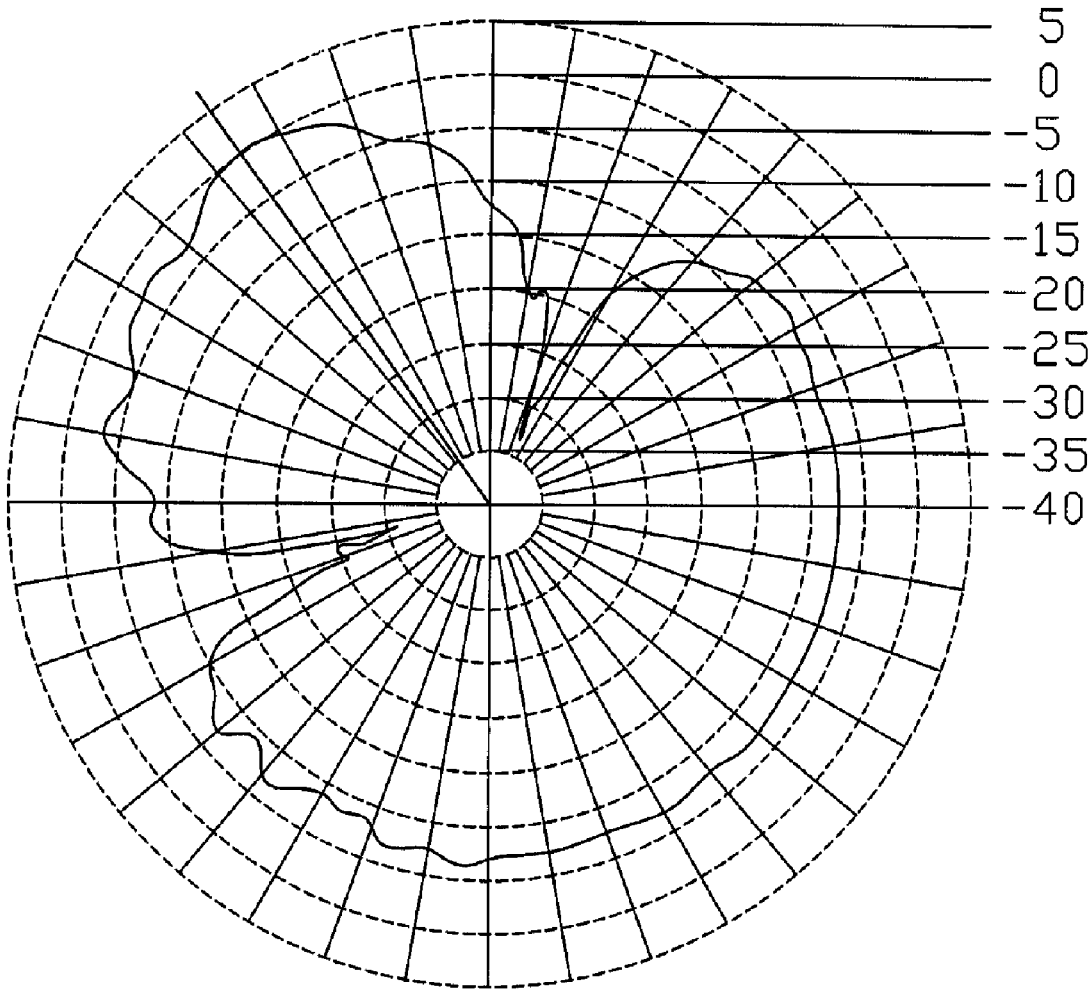
FIG. 16 is a graph of test results showing a XY plane horizontal polarization radiation pattern when the planar antenna of FIG. 2 is operated at 2.50 GHz.
Figure 17:
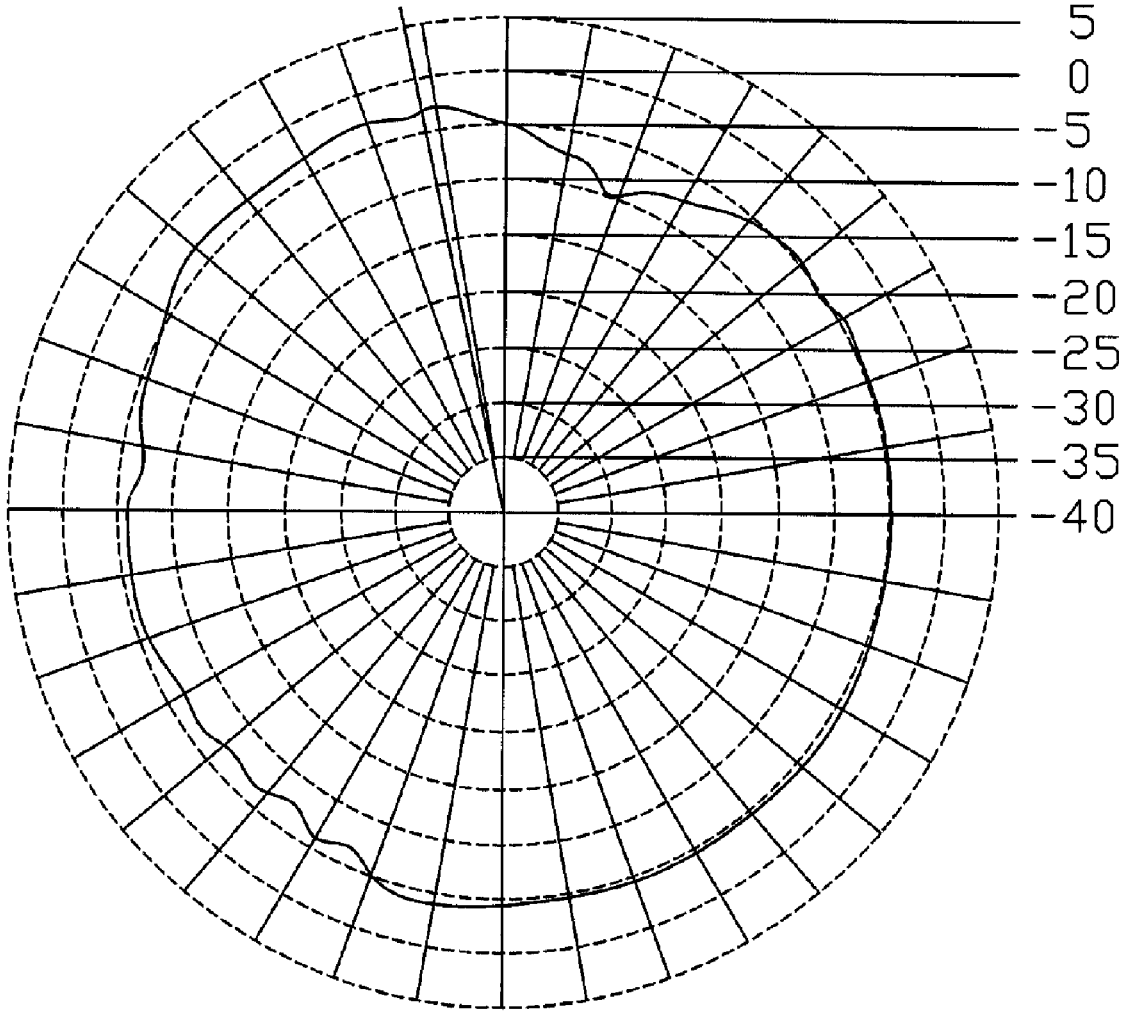
FIG. 17 is a graph of test results showing a XZ plane vertical polarization radiation pattern when the planar antenna of FIG. 2 is operated at 2.40 GHz.
Figure 18:
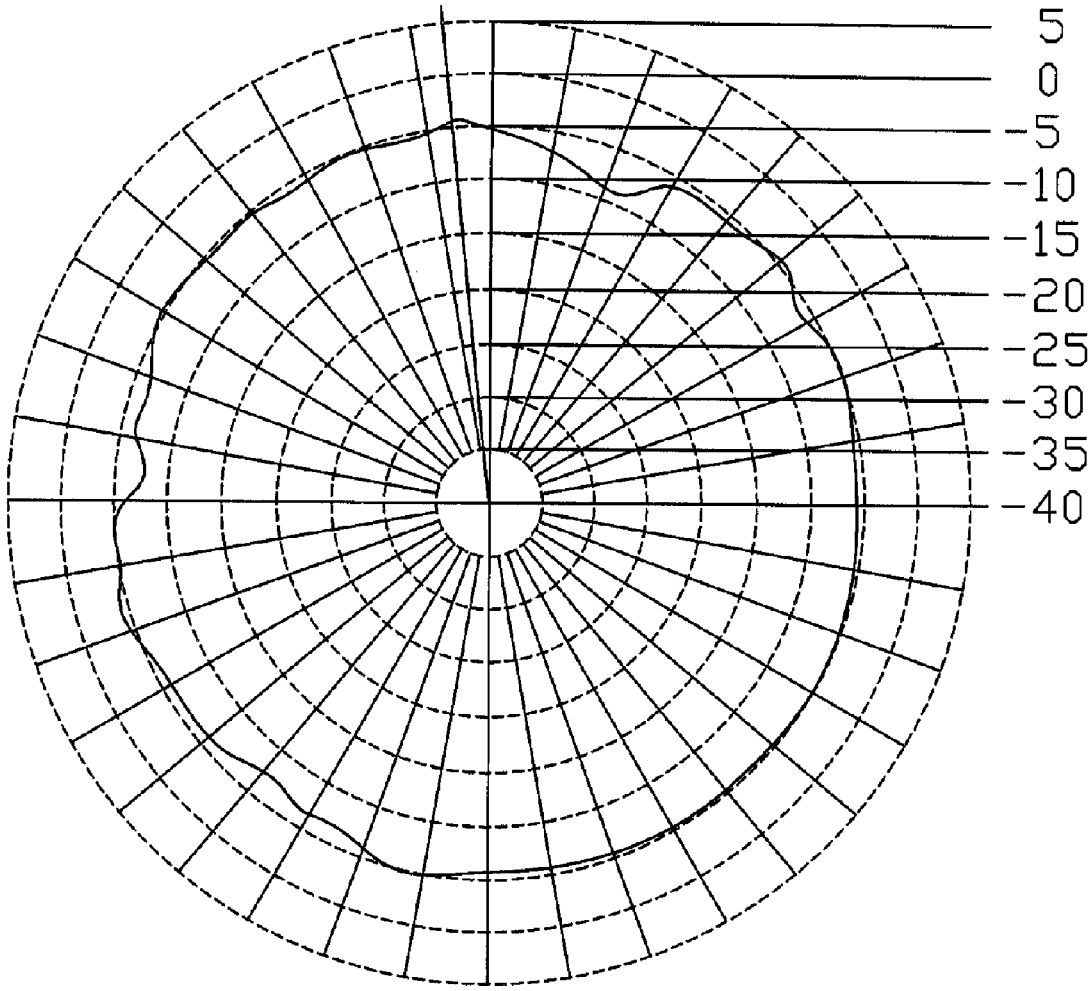
FIG. 18 is a graph of test results showing a XZ plane vertical polarization radiation pattern when the planar antenna of FIG. 2 is operated at 2.45 GHz.
Figure 19:
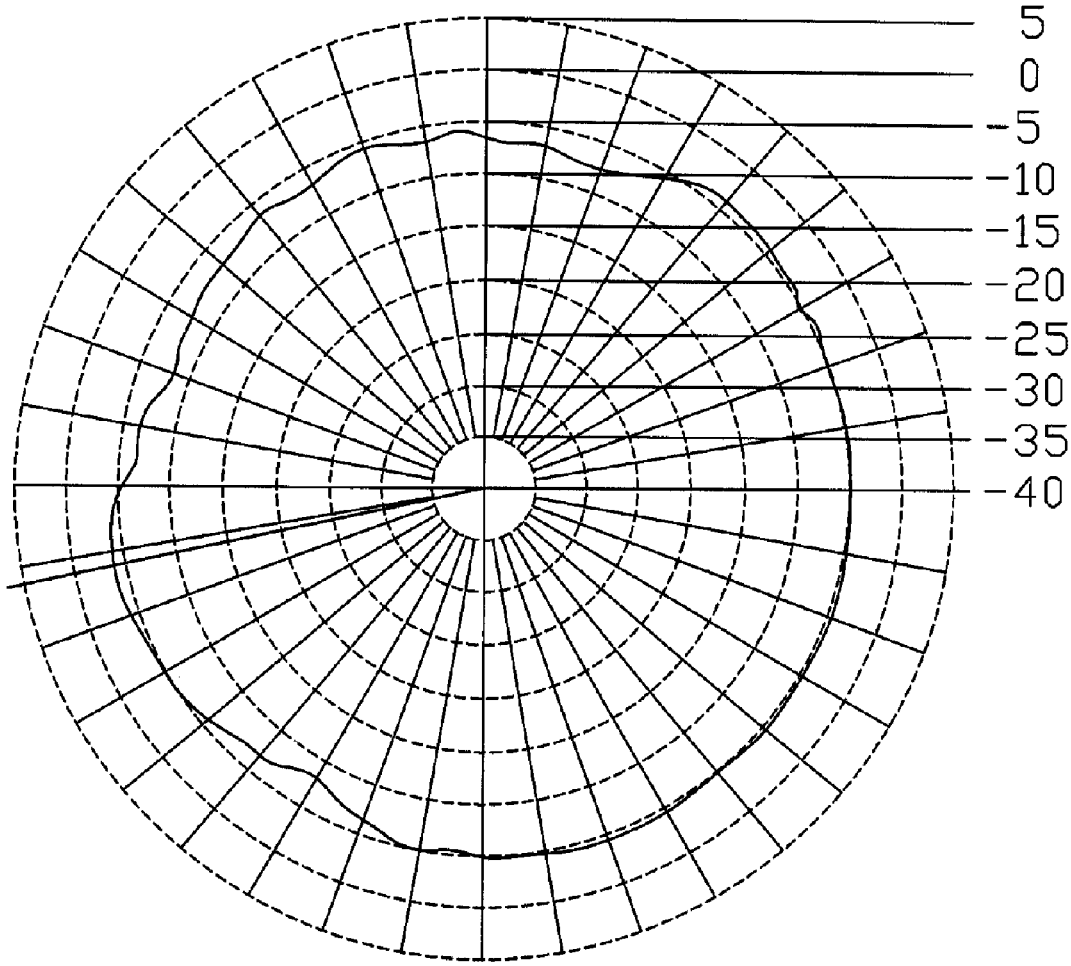
FIG. 19 is a graph of test results showing a XZ plane vertical polarization radiation pattern when the planar antenna of FIG. 2 is operated at 2.50 GHz.
Figure 20:
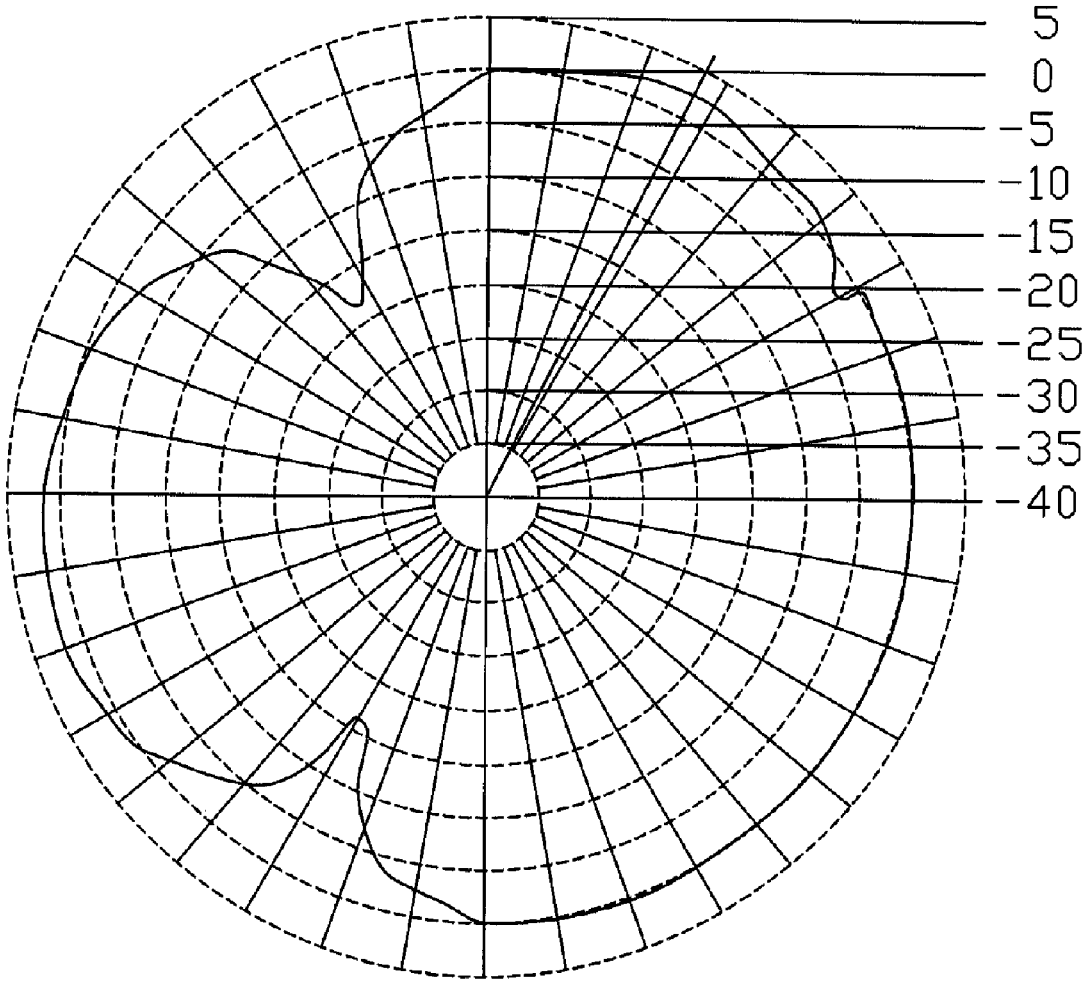
FIG. 20 is a graph of test results showing a XZ plane horizontal polarization radiation pattern when the planar antenna of FIG. 2 is operated at 2.40 GHz.
Figure 21:
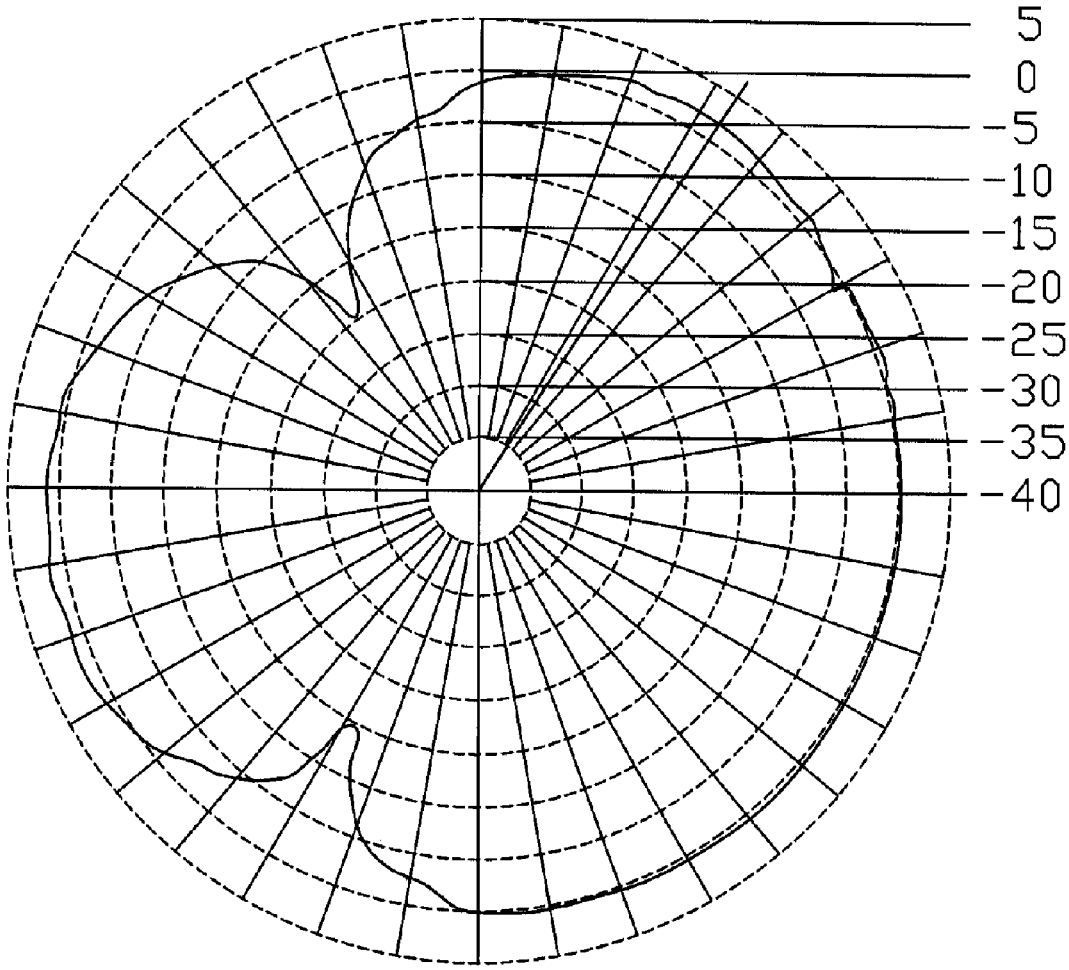
FIG. 21 is a graph of test results showing a XZ plane horizontal polarization radiation pattern when the planar antenna of FIG. 2 is operated at 2.45 GHz.
Figure 22:
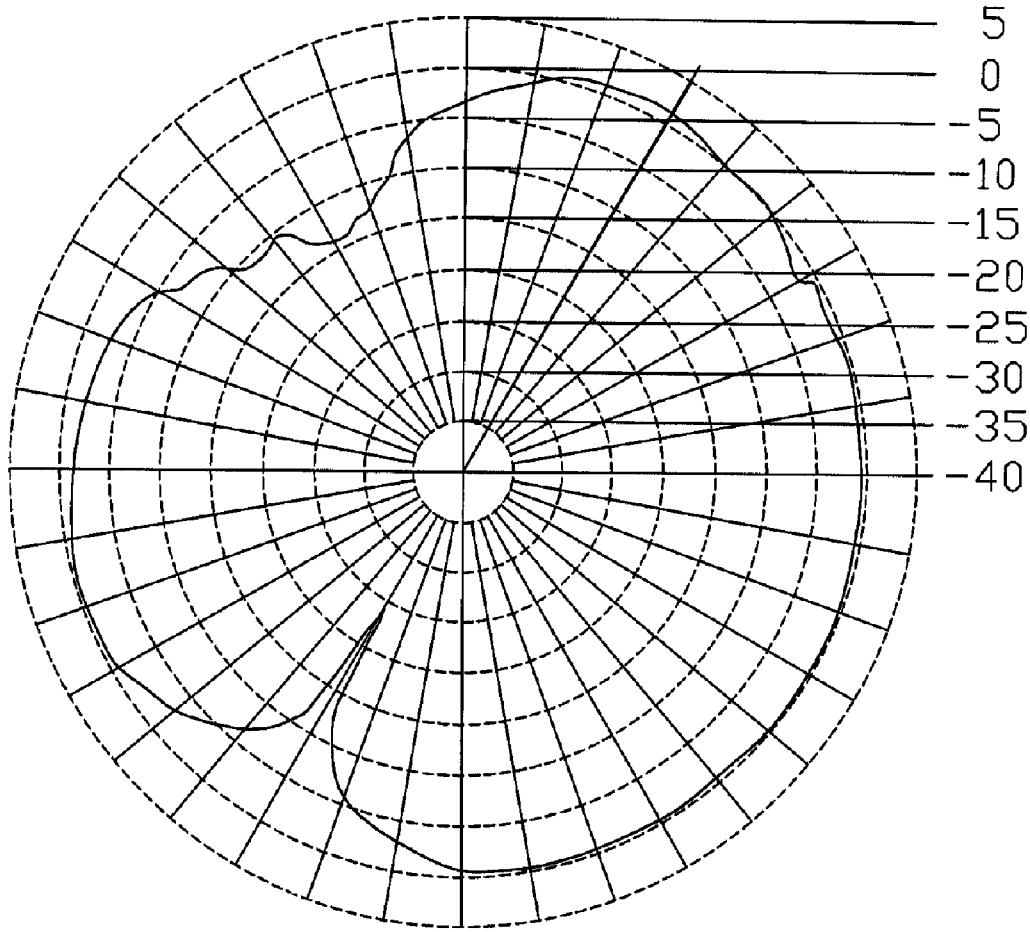
FIG. 22 is a graph of test results showing a XZ plane horizontal polarization radiation pattern when the planar antenna of FIG. 2 is operated at 2.50 GHz.

FIG. 4 is a graph of test results showing a return loss of the planar antenna when used in a wireless communication device, with the return loss as its vertical coordinate thereof and the frequency as its horizontal coordinate. When the planar antenna operates at frequency bands of 2.4~2.5 GHz, return loss drops below −10 dB, which satisfactorily meets normal practical requirements.

FIGS. 5-22 are graphs of test results showing YZ, XY, and XZ plane vertical/horizontal polarization radiation patterns when the planar antenna of FIG. 2 is operated at 2.40 GHz, 2.45 GHz, and 2.50 GHz, respectively. As seen, all of the radiation patterns are substantially omni-directional.

Although various embodiments have been described above, the structure of the planar antenna should not be construed to be limited for use in respect of IEEE 802.11 only. When the size and/or shape of the planar antenna is changed or configured appropriately, the planar antenna can function according to any of various desired communication standards or ranges. Further, in general, the breadth and scope of the invention should not be limited by the above-described exemplary embodiments, but should be defined only in accordance with the following claims and their equivalents.

What is claimed is:

1. A planar antenna, disposed on a substrate, comprising:

a metallic ground plane, laid on the substrate;

a radiating part, for transmitting and receiving radio frequency (RF) signals, the radiating part comprising an open end and a first bent portion electrically connected to the open end, wherein the first bent portion improves a return loss and increases bandwidth of the planar antenna, and reduces a profile and a size of the planar antenna;

an open-short transforming part, electrically connected between the radiating part and the metallic ground plane, the open-short transforming part comprising a second bent portion for reducing a profile and a size of the planar antenna;

a joint portion, for connecting the open-short transforming part and the radiating part, and defining a recessed portion for improving the return loss of the planar antenna; and a feeding part, electrically connected to the joint portion, for feeding signals.

2. The planar antenna as claimed in claim 1, wherein the extending direction of the second bent portion is substantially vertical to the extending direction of the first bent portion.

3. The planar antenna as claimed in claim 1, wherein the first bent portion has two or more overlapping portions.

4. The planar antenna as claimed in claim 1, wherein the second bent portion has two or more overlapping portions.

5. The planar antenna as claimed in claim 1, wherein the open end terminates the radiating part.

6. The planar antenna as claimed in claim 1, wherein the recessed portion is shaped as a polygon.

7. The planar antenna as claimed in claim 1, wherein the metallic ground plane comprises an opening.

8. The planar antenna as claimed in claim 7, wherein the feeding part passes the opening.

9. The planar antenna as claimed in claim 8, wherein a side of the open-short transforming part adjacent to the feeding pan is substantially aligned with a side of the metallic ground plane adjacent to the feeding part.

10. The planar antenna as claimed in claim 8, wherein a side of the open-short transforming part adjacent to the feeding part is offset with a side of the metallic ground plane adjacent to the feeding part.

11. The planar antenna as claimed in claim 1, wherein the feeding part is connected to a first side of the joint portion, and the recessed portion is defined at a second side of the joint portion opposite to the first side of the joint portion.

12. The planar antenna as claimed in claim 11, wherein the recessed portion comprises an extending end into the joint portion close to and aligned with the feeding part.

13. An antenna comprising:

a radiating part extending to be formed on a substrate for transmitting and receiving radio frequency (RF) signals;

an open-short transforming part electrically connectable with said radiating part and extending on said substrate away from said radiating part to be grounded;

a join: portion extending between said radiating part and said open-short transforming part to join said radiating part to said open-short transforming part for electrical connection a feeding part electrically connectable with a first side of said joint portion and extending away from said joint portion in order for transmitting said RF signals out of said antenna; and a recessed portion definable in said joint portion to extendably form into said joint portion from a second side of said joint portion opposite to said first side of said joint portion, said recessed portion comprising an extending end into said joint portion close to and substantially aligned with said feeding part.

14. The antenna as claimed in claim 13, wherein said extending end of said recessed portion is the narrowest of said recessed portion.

15. The antenna as claimed in claim 13, wherein said radiating part comprises a bent portion crookedly formed to neighbor said joint portion.

16. The antenna as claimed in claim 13, wherein said open-short transforming part comprises a bent portion crookedly formed therein.

17. An antenna formed along a substrate, comprising:

a radiating part for transmitting and receiving radio frequency (RF) signals;

an open-short transfonning part electrically connectable with said radiating part and extending on said substrate away from said radiating part to be grounded;

a joint portion extending between said radiating part and said open-short transforming part to join said radiating part to said open-short transforming pan for electrical connection, at least one bent portion crookedly definable in said open-short transforming part, wherein the joint portion defines a recessed portion for improvng the return loss of the antenna; and a feeding part electrically connectable with said joint portion and extending away from said joint portion in order for transmitting said RF signals out of said antenna.

18. The antenna as claimed in claim 17, wherein said radiating part comprises another bent portion crookedly formed to neighbor said joint portion.

19. The antemia as claimed in claim 17, wherein said feeding part is connected to a first side of said joint portion, and said recessed portion is defined at a second side of said joint portion opposite to said first side of said joint portion.

20. The antenna as claimed in claim 19, wherein said recessed portion comprises an extending end into said joint portion close to and aligned with said feeding part.

* * * * *